United States Patent [19]

Jones

[11] 4,233,773

[45] Nov. 18, 1980

[54] ATTACHMENTS IN MODEL AIRPLANES

[76] Inventor: Robert S. Jones, 311 Lakeview Ave., Clifton, N.J. 07011

[21] Appl. No.: 952,114

[22] Filed: Oct. 17, 1978

[51] Int. Cl.[3] ..... A63H 24/02

[52] U.S. Cl. ..... 46/76 R

[58] Field of Search ..... 46/76 R, 76 A, 77, 78, 46/79, 81; 244/120, 131

[56] References Cited

U.S. PATENT DOCUMENTS

| | | | |
|---|---|---|---|
| Re. 17564 | 1/1930 | Schutte | 46/78 |
| 2,942,814 | 6/1960 | Schuerch et al. | 244/131 |
| 3,935,664 | 2/1976 | Neuhierl | 46/76 R |

FOREIGN PATENT DOCUMENTS

| | | | |
|---|---|---|---|
| 63913 | 9/1945 | Denmark | 46/76 R |
| 2642550 | 2/1978 | Fed. Rep. of Germany | 46/76 R |

*Primary Examiner*—F. Barry Shay

*Attorney, Agent, or Firm*—Ralph R. Roberts

[57] ABSTRACT

The present invention is directed to a positive removable mounting of a wing and, if desired, the tail assemblage. This attachment provides a spring biased mounting means at one side of the mounted member and one or two pins or dowels are inserted into receiving holes provided. The opposite side is brought to fixed hole portions and one or more fixed pins or dowels are placed in these holes. The wing or tail assembly is rearwardly moved with and by bias to retain the wing or tail in position until moved forwardly. This forward movement is produced by a crash or sudden stop or by the operator when he wishes to disassemble the craft.

9 Claims, 6 Drawing Figures

ATTACHMENTS IN MODEL AIRPLANES

SUMMARY OF THE INVENTION

1. Field of the Invention

With reference to the classification of art as established by and in the United States Patent Office the present invention is believed to be found in the general Class entitled, "AERONAUTICS" (Class 244) and to the subclasses, "Fuselage and body construction" (subclass 119) and "sectional" (subclass 120) and to the general Class entitled, "Amusement Devices, Toys" (Class 46) and the subclass entitled, "airplanes" (subclass 76 R).

2. Description of the Prior Art

There has been some effort and patents directed toward the removable mounting of components on aircraft. A pre-Ex search of the art found the following U.S. Pats. No. 1,949,304 to HARDIN as issued on Feb. 27, 1934 shows a pin fastening of a lower fuselage to a gas bag. These pins are of large size and are manually manipulated to secure the passenger cabin to the gas bag. U.S. Pat. No. 2,004,235 to BURKHARD as issued on June 11, 1935 shows a pin securing of dummy bombs. U.S. Pat. No. 2,403,250 to VERHAGEN as issued on July 2, 1946 shows a pin securing of a canopy to an aircraft fuselage. U.S. Pat. No. 2,496,087 to FLEMING as issued on Jan. 31, 1950 shows a gang connecting means of aircraft by a pin and spring biased hook. U.S. Pat. No. 3,935,664 to NEUHIERL as issued on Feb. 3, 1976 shows a connector arrangement that employs a turn key member. U.S. Pat. No. RE 17,564 to SCHUTTE as issued on Jan. 14, 1930 shows wings of model planes attached by mounting on protruding wires.

The use of model airplanes and the powering of them by two cycle combustion motors has become widespread. Usually these flying models have a radio receiver which receives one or more signals from a ground transmitter. The attention to authentic reproduction has made the method of securing a wing in place by exterior means less than desirable. The removal of the wing is desirable when transporting of the aircraft to a flight site. The present invention allows the ready mounting and dismounting of the wing by the operator without rubber bands, Nylon bolts and the like for inspection and/or replacement of components. The wing is also dislodged when a crash or sudden forward stop occurs. The present invention contemplates ready replaceable mounting of a tail assembly and, of course, a wing without exterior rubber bands.

SUMMARY OF THE INVENTION

This invention may be summarized at least in part with reference to its objects.

It is an object of this invention to provide, and it does provide, a means for the ready mounting and dismounting of the wing, and/or tail assembly by a simple manipulation and without the use of rubber bands.

It is a further object of this invention to provide, and it does provide, a spring biased mounting means whereby this bias is provided at one side of the mounted member and one or two pins or dowels are inserted into receiving holes provided. The opposite side is brought to fixed hole portions and one or more fixed pins or dowels are placed in these holes. The wing or tail assembly is rearwardly moved with and by the bias to retain the wing or tail in position until moved forwardly. This forward movement is produced by a crash or sudden stop or by the operator when he wishes to disassemble the craft.

In brief, this invention provides a simple but highly effective means for removably mounting a wing and/or tail assemblage to a fuselage of a model airplane. This wing and/or tail assemblage has at least two pin or dowel members at the foreportion of the mounting means. These pins or dowels enter prepositioned holes in a bulkhead of the fuselage. A spring bias is actuated by the forward movement of these pins and the wing and/or tail assembly causes this spring bias means to compress and allow a forward movement sufficient for fixed rear pins to be brought in way of rear prepositioned holes formed in the bulkhead. The rear pin or pins are then slid into place by and with a rear movement of the spring biased member. When rearward movement is completed, the removable mounting is achieved and the wing and/or tail assemblage is removably mounted in a predisposed position on the model aircraft.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of the spring bias means as adopted for use in model aircraft and showing a preferred means for mounting wings and tail assemblages. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the several figures of the drawings.

The drawings accompanying, and forming part of, this specification disclose certain details of construction for the purpose of explanation, but structural details may be modified without departure from the concept and principles of the invention and the invention may be incorporated in other structural forms than shown.

DESCRIPTION OF THE APPARATUS

Figure 2:
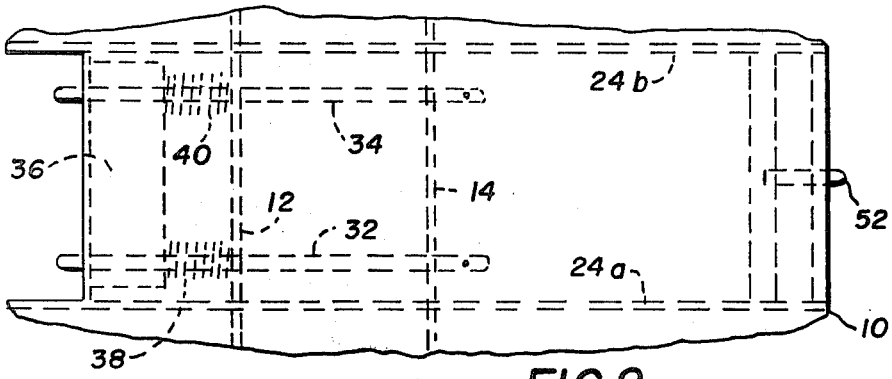
FIG. 2 represents a plan or top view, partly fragmentary, of the top wing as used with the mounting of the wing in FIG. 1 shown as a sectional view.
Figure 1:
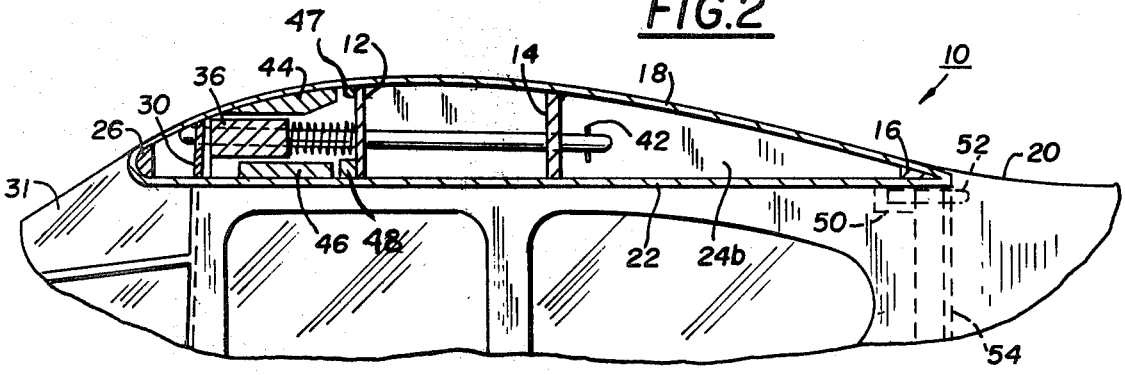
FIG. 1 represents a partly diagrammatic fragmentary side view with the wing portion shown in section and the body portion shown in outer appearance, this view of a model airplane showing the mounting of an upper wing into the fuselage and employing one means of supplying a spring bias.
Figure 4:
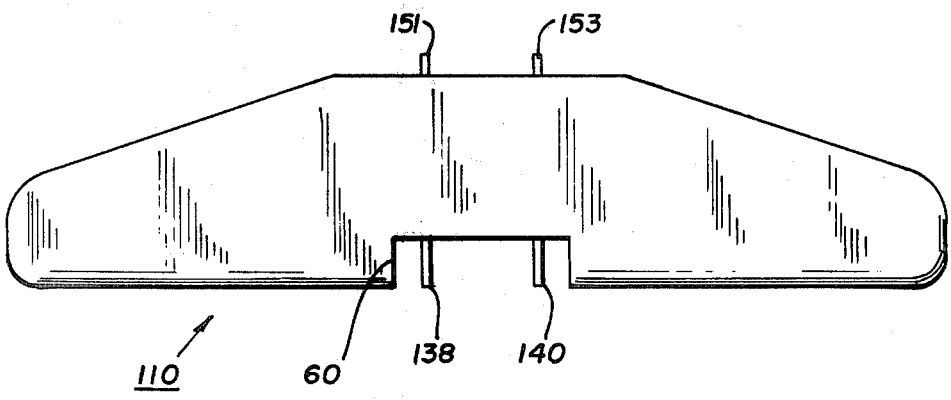
FIG. 4 represents a plan view of the lower wing as shown in FIG. 3.

Wing attaching Means of FIGS. 1 and 2

Referring now to the drawings and in particular to FIGS. 1 and 2, there is depicted a wing member generally identified as 10. This wing member has longitudinal strength members 12 and 14 which conventionally extend the full extent of the wing length. A rear member 16 also provides the trailing edge of the wing. A top covering 18 of the wing is shown and in mounted condition matches the contour of the fuselage 20. A lower covering 22 of the wing is also made. Spars 24 are spaced along the wing to provide the contour attachment of the upper and lower cover. Diagrammatically shown is a leading edge member 26 of the wing. This leading edge portion between spars 24*a* and 24*b* is not present in the wing where it is removably attached to the fuselage.

A bulkhead 30 shown in section in FIG. 1 is provided in the fuselage portion of the aircraft. A windshield 31 is attached to the fuselage and is forward of this bulkhead portion 30 in and of the fuselage. A pair of holes of a selected size are positioned in this bulkhead and are adapted to receive and retain dowels 32 and 34 carried by and secured in block 36. This block is biased forwardly by compression springs 38 and 40 which for convenience are slidably mounted on rearwardly extending portions of the dowels 32 and 34. Longitudinal member 12 has a pair of holes formed therein for the slidable retention of the dowels 32 and 34. This longitudinal member also provides the rearward stop for the springs 38 and 40. The other longitudinal member 14 also has a pair of holes sized and spaced for slidable guiding and retention of the dowels 32 and 34. Stop pins 43 provide a forward limiting stop of the dowels 32 and 34 as well as the block 36 preventing accidental dislodgement or loss of the dowel and spring assembly.

A top guide block 44 is carried in the wing member and between spars 24*a* and 24*b*. A bottom guide block 46 is also carried in and by the wing 10 and extends between spars 24*a* and 24*b*. It is to be noted that the lower or bottom guide block is made with its front face so positioned that the movable block 36 can be moved a distance rearwardly before the lower guide block is brought to a stop produced by the compression of springs 32 and 34.

Between spars 24*a* and 24*b* there is no leading edge portion 26. The top guide block 44 extends to a point that is near to the bulkhead 30 when the wing is in a mounted condition as in FIG. 1. The longitudinal member 12 may have reinforcing portions 47 and 48, if desired. A transverse block or member 50 carried in the fuselage extends between and below spars 24*a* and 24*b*. Extending rearwardly therefrom is a pin or dowel 52 which enters and is retained in an appropriately sized hole formed in bulkhead 54 carried by and secured in said fuselage 20. Block 50 provides an abutting stop against bulkhead 54 to prevent further rearward movement of wing 10.

To mount the wing member 10 to the fuselage the wing member is aligned so that the spars 24*a* and 24*b* straddle the opening in the fuselage 20. The dowels 32 and 34 are entered in the holes formed in bulkhead 30 and the block 36 which carries these dowels is movable back along and against the bias of springs 38 and 40. This manipulation is manually achieved by the operator who moves block 36 toward member 12. When the wing is forced sufficiently forward, said wing is manipulated so that the pin 52 is brought in way of a hole formed in bulkhead 54 and the wing is moved rearwardly until block 50 engages the bulkhead 54. The wing is now in the mounted position. A crash, sudden stop or a manual removing manipulation causes the wing to be moved forwardly against the spring bias and as dowel 52 is moved moves from the hole in bulkhead 54 to dislodge or permits dislodgement of the wing from the fuselage for internal examination of components. A plurality of rear dowels or pins may be used, if desired.

Embodiment of FIGS. 3, 4, 5 and 6

Figure 3:
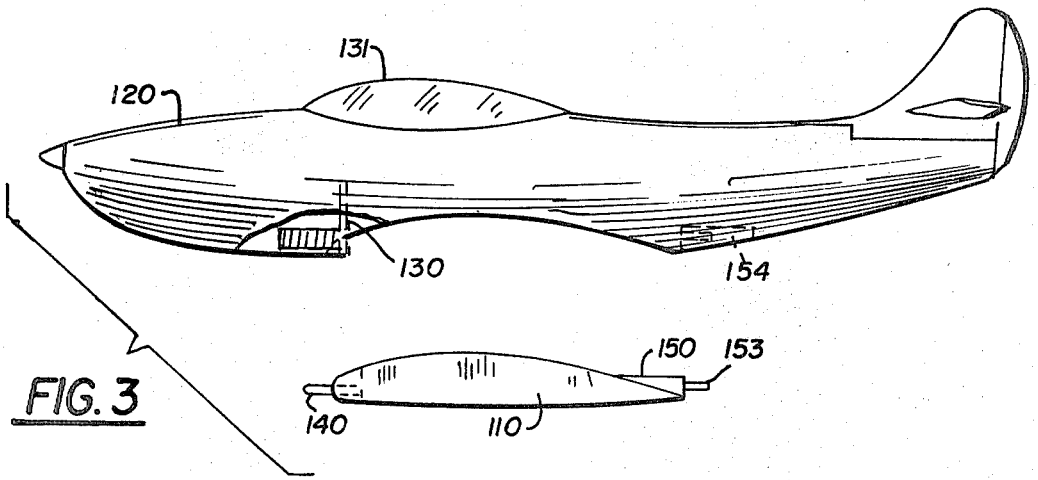
FIG. 3 represents a side view, partly diagrammatic, of a low wing model airplane and showing an alternate means for mounting a wing to the fuselage.

Referring next and finally to the attachment means shown in FIGS. 3, 4, 5 and 6, it is to be noted that the spring bias means is carried in a bulkhead. In FIG. 3 a fuselage 120 has a canopy or windscreen 131 and depicts a low wing monoplane. As viewed in FIGS. 3 and 4, a lower wing 110 has fixed forwardly projecting dowels or pins 138 and 140. This wing is cut out at 60 to permit this wing to be moved forwardly to bring rear projecting pins or dowels 151 and 153 which are fixed in abutting stop or block 150 in way of holes formed in a rear bulkhead block member 154. A forward bulkhead 130 carried in the fuselage 120, as seen in detail in FIG. 5, carries a tubular metal ferrule member 62 having a forward closed end member 64. A compression spring 66 is carried in this tubular metal member and is secured to both the end closure and a front disc member 68.

In operation, the ferrule members 62 are secured in approximate holes formed in the forward bulkhead 130. The spring members 66 and the front disc member 68 in an unstressed condition bring the disc member to or nearly to the end of the tubular portion 62. The wing 110 is manipulated so that dowels or pins 138 and 140 enter the tubular portions 62. Continued forward motion or manipulation of this wing causes the disc member 68 to move forwardly compressing the springs 66 to an extent sufficient for the rear dowels 151 and 153 fixed in block 150 to be brought in way of presized and positioned holes in block 154. After these rear pins are aligned with the holes in rear block 154, the pins are caused to enter these holes and the wing is moved rearwardly until the rear block 150 of the wing 110 engages and is stopped by the block 154. The gap 60 in the wing 110 that is open at the lower front is closed by a separate attachable piece not shown.

Figure 5:
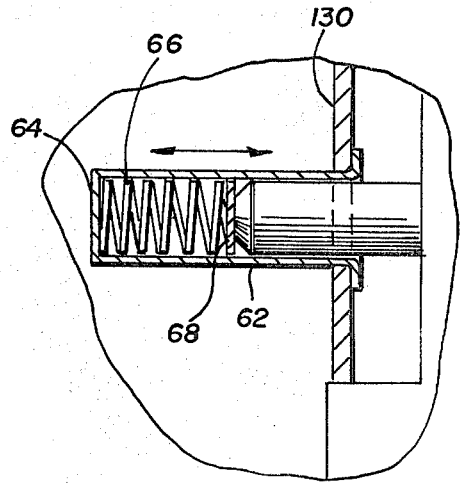
FIG. 5 represents in an enlarged scale a spring bias means for retaining a wing and/or tail assemblage.
Figure 6:
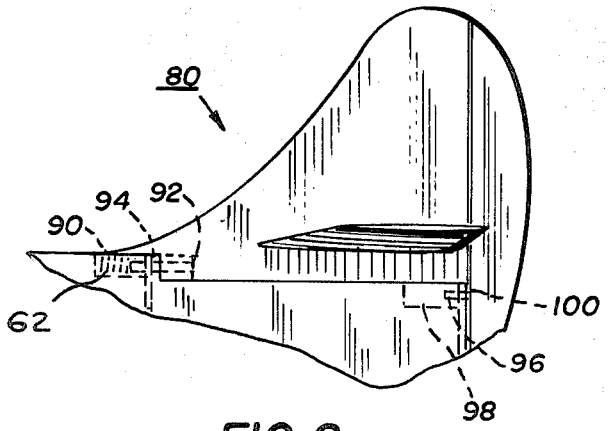
FIG. 6 represents a side view, partly diagrammatic, and showing a tail assemblage using the spring bias means of FIG. 5.

The apparatus shown in FIG. 5 can be used to attach in a removable manner a tail assemblage. In FIG. 6 is depicted a tail assembly generally identified at 80. A forward block 90 carries a pair of ferrule assemblies including tubular members 62, end closures 64, springs 66 and front discs 68. A pair of dowels or pins 92 are secured in a block 94 and are in a fixed portion of the tail assemblage. A rear pair of dowels or pins 96 are secured to and are carried in a block 98 which is a fixed portion of the tail assemblage. Block 100 is fixed to and is carried by the fuselage of the aircraft model. To mount the tail portion the dowels 92 are brought in way of the ferrule openings and are pushed forwardly against the bias of the springs 66. Block 90 is sufficiently back from the front of the dowels or pins 92 so that the forwardly manipulated tail assemblage may be brought to and positioned with the rear dowel or pins 96 in way of the openings in block 100. The tail assemblage is then moved backwardly to position the tail assemblage against block 100.

It is to be noted, instead of coil springs that leaf springs and/or resilient material such as synthetic rubber may provide the spring bias shown. The tail assembly shown in FIG. 6 often has rudder and elevator control remotely controlled by a radio receiver and transmitter. Small connecting plugs well known to the model makers can be used. For sliding clearance small gaps of about one thirty-second of an inch (0.79 mm.) may be provided around the wings and tail assembly surfaces. For appearance, larger spaces may have removable inserts. Preferably all removably attached components that are spring biased into and are retained in position by that bias means are sufficiently free to move so that a crash or sudden stop will tend to cause the wing and/or tail assemblage to dislodge and separate in more-or-less free condition.

This attachment means is also applicable when the model is an aircraft of two or more wings. This would apply to World War I vintage models. Tail and fuselage designs of plural number are also contemplated to be mounted with the biased means above disclosed. The spring ferrule, particularly as shown in FIG. 5, may be supplied with kits or as a retrofit on existing model aircraft. The forward mount preferably has two pins or dowels but a single pin may be used as long as lateral and vertical alignment and orientation are maintained. The rear of the mount may be one or more pins or protrusions fitting into appropriately formed sockets. The rear mounting means has no bias and when mounting is achieved no forward to back motion is possible except against the spring bias.

The above embodiments and description discuss a pin or dowel for the securing means. This is not intended to preclude the use of an oval or rectangular pin or dowel. Such a configuration may easily be made of a strip of metal which then could be inserted into and be retained by a leaf spring having an appropriately shaped hole formed therein. Such a mounting can and could be used with either a wing or tail assembly or both. The above embodiments shown present the preferred biasing means but do not limit the mounting arrangements whereby the forward portion of the wing or tail assemblage is mounted in a guideway and against a bias. The wing or tail assemblage is urged forwardly until a rear guide can be brought in way of a complementary formed portion in a rear bulkhead. The rear pin or guide means could be attached to and extend forwardly from the bulkhead and then be inserted into a hole formed in the movable and insertable component.

It is to be also noted that the spring assemblies may be carried in and mounted in the removable member. Thus, the wing and/or tail assemblies may have the spring bias and the bulkhead of the airframe or fuselage may carry a fixed dowel or pin. As noted, in a like manner the rear pin means may be secured to the bulkhead and mating holes formed in the matching portion of the movable member. This reversing of the mounting means is contemplated and may be provided where and when desired. It is contemplated that the wing and/or tail assemblies are removably mounted in a fuselage and are moved forwardly against a spring bias and rear pins are brought in way of the positioning holes and then the movable member is moved backwardly with the assist of the spring bias to the final flying position.

Terms such as "left", "right", "up", "down", "bottom", "top", "front", "back", "in", "out" and the like are applicable to the embodiments shown and described in conjunction with the drawings. These terms are merely for the purposes of description and do not necessarily apply to the position in which the wing and tail assemblies may be constructed or used.

While particular embodiments of the attachment means for the wing and tail to a fuselage have been shown and described it is to be understood the invention is not limited thereto since modifications may be made within the scope of the accompanying claims and protection is sought to the broadest extent the prior art allows.

What is claimed is:

1. A combination including biased attaching means for selectively mounting a component to the fuselage of a model aircraft, said attaching means including: (a) at least one forwardly extending projection carried by and in the to-be-removably attached component; (b) a receiving hole for said projection of selected size and position, said hole formed in a forward bulkhead portion of the fuselage; (c) a bias means cooperatively associated with said forward bulkhead portion and projection and adapted to permit a limited forward movement of the to-be-attached component against the resistance of the bias means; (d) at least one rearwardly extending projection fixedly secured to the to-be-removably attached component, said rearwardly extending projection being fixed in an abutting stop, and (e) a receiving hole of selected size and position formed in a rear bulkhead portion of the fuselage and adapted to slidably retain this rear projection whereby when the forwardly extending projection is brought to the receiving hole in the forward bulkhead and the to-be-attached component is moved forwardly against the bias means, forward movement is sufficient for the end of the rearwardly extending projection to be brought in way of the receiving hole in the rear bulkhead portion whereby a rearward movement with the assistance of the bias means may be made and the abutting stop brought to and against the rear bulkhead to mount the component by the front and rear projections.

2. A combination including biased attaching means as in claim 1 in which said projection is a pair of dowels carried as a part of the forwardly extending attaching means, said dowels being slidably carried in guide means in the to-be-attached component and with the dowels urged forwardly with and by spring means carried with the to-be-attached component.

3. A combination including biased attaching means as in claim 2 in which the spring means is a compression spring carried on each of the dowels and with a limiting means carried by the dowel to limit the forward movement of the dowel.

4. A combination including biased attaching means as in claim 3 in which there are two dowels providing the rearwardly extending attaching means.

5. A combination including biased attaching means as in claim 1 in which said projection is a pair of fixed forwardly extending dowels and the bias means is carried in tubular guideways in a forward bulkhead.

6. A combination including biased attaching means as in claim 5 in which the bias means includes a ferrule housing having a flanged open end with the other end sufficiently closed to contain a compression spring which is secured in and to this far end of the ferrule, the other or free end of the spring having a stop means adapted to engage the end of a dowel which is brought into the ferrule.

7. A combination including biased attaching means as in claim 6 in which the ferrule housing is of metal and the free end of the spring carries a closure disc member secured thereto.

8. A combination including biased attaching means as in claim 1 in which the to-be-attached component is a wing.

9. A combination including biased attaching means as in claim 1 in which the to-be-attached component is a tail assembly.

* * * * *